United States Patent [19]

Sainsbury

[11] Patent Number: 5,058,739

[45] Date of Patent: Oct. 22, 1991

[54] CIGARETTE SPACER

[76] Inventor: Arthur W. Sainsbury, 103 Pine St., S. Easton, Mass. 02375

[21] Appl. No.: 646,428

[22] Filed: Jan. 28, 1991

[51] Int. Cl.[5] ..... A24F 15/00; B65D 85/10

[52] U.S. Cl. ..... 206/252

[58] Field of Search ..... 206/252, 255, 256

[56] References Cited

U.S. PATENT DOCUMENTS

| | | | |
|---|---|---|---|
| 614,428 | 11/1898 | Humann | 206/255 |
| 1,408,464 | 3/1922 | Moeller | 206/255 |
| 2,185,605 | 1/1940 | Murphy et al. | 206/252 |
| 2,331,035 | 10/1943 | Lundstrom | 206/252 |
| 2,510,630 | 6/1950 | Goldsworthy | 206/252 |

*Primary Examiner*—William I. Price

[57] ABSTRACT

This is a combination of cigarette package, cigarettes and an accordian like cigarette spacer. The boxlike cigarette package has first and second short sides and a second short side which are in spaced parallel relation with each other. The cigarettes are positioned between the first and second short sides typical of the presently available cigarette package. The cigarette spacer is positioned between the first short side and the cigarettes placing the spacer under compression so that removal of some cigarettes will relieve the pressure causing the cigarette spacer to expand.

5 Claims, 2 Drawing Sheets

CIGARETTE SPACER

BACKGROUND OF THE INVENTION

Field of the Invention

This invention relates to cigarette packaging and more specifically to a cigarette package.

SUMMARY OF THE INVENTION

The invention disclosed herein is directed at a cigarette package, cigarettes and a cigarette spacer. The cigarette package comprising a box having a first short side and a second short side. The first and second short sides in spaced parallel relation with each other. The cigarettes positioned between the first and second short sides. The cigarette spacer is positioned between the first short side and the cigarettes whereby removal of some cigarettes will cause the cigarette spacer to expand.

BRIEF DESCRIPTION OF THE DRAWINGS

Further details are explained below with the help of the example(s) illustrated in the attached drawings in which.

DESCRIPTION OF THE PREFERRED EMBODIMENT(S)

Figure 1:
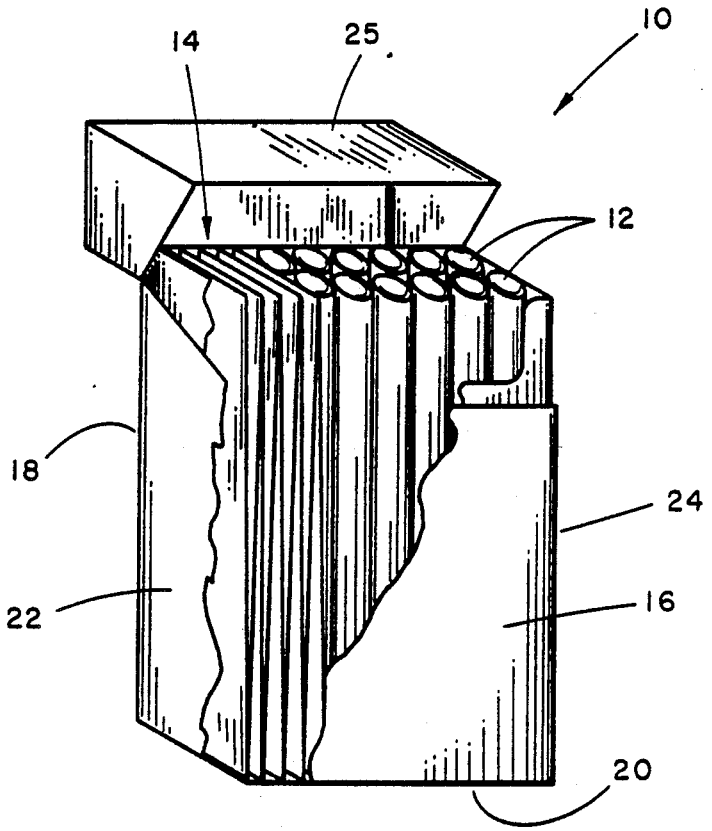
FIG. 1 is a side elevational view of the combination of a cigarette package, cigarettes and a cigarette spacer, the package partly broken away to show the cigarettes and the cigarette spacer according to the present invention.

There is shown in the drawings the combination of a cigarette package 10, cigarettes 12 and a cigarette spacer 14. The cigarette package 10 comprising a front panel 16, a back panel 18, a base 20, a first short side 22, a second short side 24 and a cap 25. The base 20 includes a first short edge 26, a second short edge 28, a first long edge 30 and second long edge 32. The first short side 22 extends upwardly from the first short edge 26 and is in right angle relationship therewith. The second short side 22 extends upwardly from the second short edge 28 and is in right angle relationship therewith. The front panel 16 extends upwardly from the first long edge 30 and is in right angle relationship therewith. The second long edge 32 extends upwardly from the back panel 18 and is in right angle relationship therewith. The back panel 18 and the front panel 16 connect the first short side 22 and the second short side 24 and the back panel 18 and the front panel 16 and the first short side 22 and the second short side 24 are in spaced parallel relationship with each other.

Figure 2:
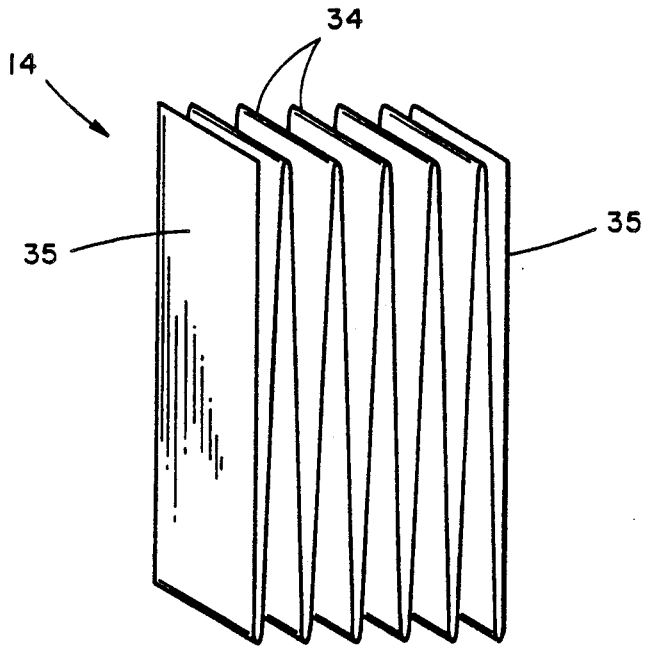
FIG. 2 is a side elevational view of the cigarette spacer shown in FIG. 1.
Figure 3:
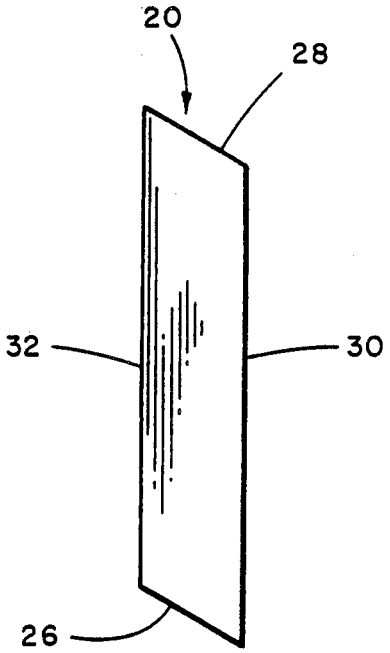
FIG. 3 is a perspective view of the base of the cigarette package shown in FIG. 1.

The cigarette spacer 14 comprises a piece of parchment having a rectangular configuration and being folded into an accordion shape, as shown in FIG. 2 providing a series of members 34. The parchment of which the cigarette spacer 14 is formed when folded into the accordion shape is under compression and attempts to expand into a flat extended rectangular shape.

Assuming that there are some cigarettes 12 in the cigarette package 10, The cigarette spacer 14 is positioned between the first and second short sides 24, 26, with the end members 34 of the cigarette spacer 14 positioned to bear against for example the first short side 24 and the cigarettes 12 holding the cigarettes 12 in a loose fixed position and if some of the cigarettes 12 are removed the cigarette spacer will expand and the members 34 will occupy the void created by the removed cigarettes 12. Obviously the cigarette spacer 14 is reusable.

Figure 4:
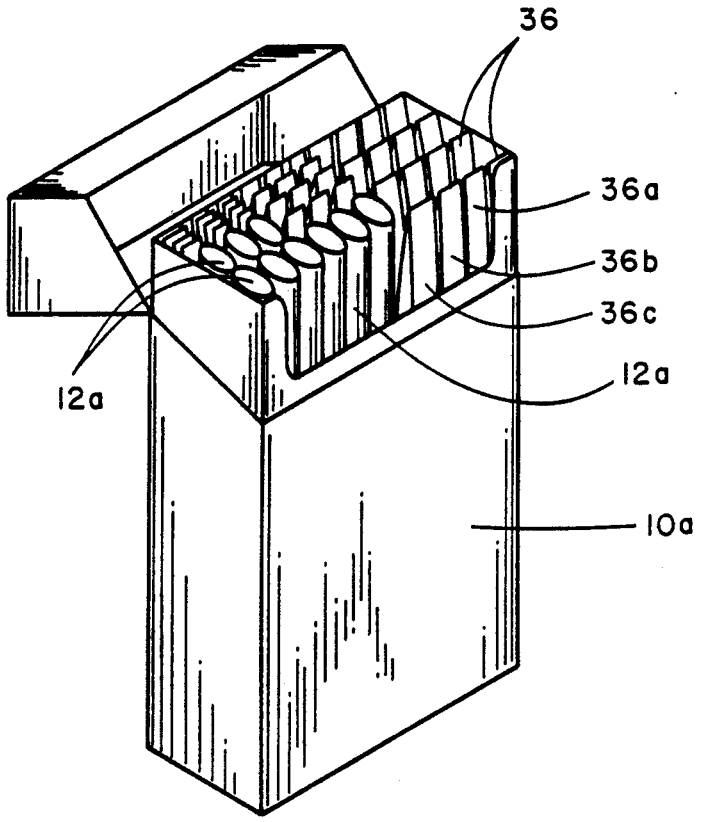
FIG. 4 is a perspective view of a cigarette package, cigarettes and a cigarette spacer, the cigarette spacer being a variation of the cigarette spacer, shown in FIG. 1, according to the present invention.
Figure 5:
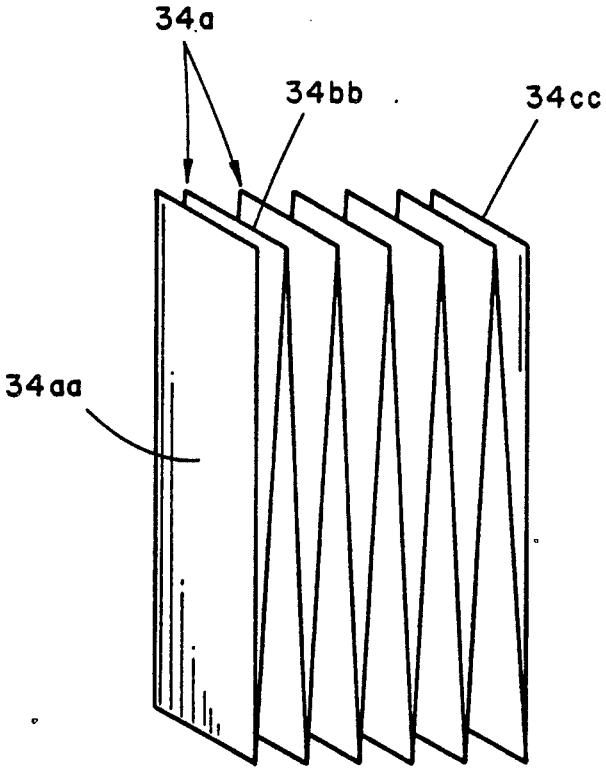
FIG. 5 is a perspective view of a series of members before being cut to provide a series of panels, according to the present invention.
Figure 6:
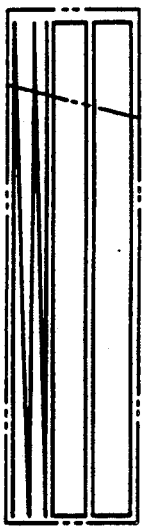
FIG. 6 is a side elevational view of the combination of the cigarette package, cigarettes and the variation of the cigarette spacer shown in FIG. 4, according to the present invention.

A variation of the cigarette spacer 14 is shown as the cigarette spacer **14*a* in FIG. 4 and comprises a piece of parchment having a rectangular configuration and being folded into an accordion shape providing a series of members 34*a*. The members 34*a* include a front member 34*aa* a second member 34*bb* and so forth until the last member 34*cc*. Each of members 34*a* is slit vertically from the top to proximate the bottom to provide a series of panels 34, 36*a*, 36*b* etc. which are aligned from what was the front member 34*aa* to the last member 36*cc*. In other words from front to back. These panels 36, 36*a*, 36*b*** are the width of a standard cigarette and are folded into the accordion shape and are under compression and each of the folded panels attempts to expand into a extended comparatively narrow rectangular shape.

Assuming that there are some cigarettes **12*a* in the cigarette package 10*a*, The cigarette spacer 14*a* is positioned as was the cigarette spacer 14 with the front panel members positioned to bear against for example the first row of cigarettes 38 holding the first row of cigarettes 38 in a loose fixed position and if some of the first row of cigarettes 38 are removed the respective panel will expand to occupy the void created by the each of the removed cigarettes 38**. This will occur with the respective panels of each row of cigarettes as it is used.

What I claim is:

1. The combination of a cigarette package, cigarettes and a cigarette spacer, the cigarette package comprising a first short side and a second short side, the first and second short sides in spaced parallel relation with each other, the cigarettes positioned between the first and second short sides, the cigarette spacer formed of a parchment material and positioned between the first short side and the cigarettes whereby removal of some cigarettes will cause the cigarette spacer to expand.

2. The combination as set forth in claim 1 wherein the cigarette spacer comprises an expandable accordian form.

3. The combination of a cigarette package, cigarettes and a cigarette spacer, the cigarette package comprising a first long side and a second long side, the first and second long sides in spaced parallel relation with each other, the cigarettes positioned between the first and second long sides, the cigarette spacer formed of a parchment material and positioned between the first long side and the cigarettes and comprises an expandable accordion form whereby removal of some cigarettes will cause the cigarette spacer to expand the cigarette spacer.

4. The combination of a cigarette package, cigarettes and a cigarette spacer, the cigarette package comprising a first short side and a second short side, the first and second short sides in spaced parallel relation with each other, the cigarettes positioned between the first and second short sides, the cigarette spacer positioned between the first short side and the cigarettes and further comprising an expandable accordion form and a series of members, each of the members having a top and bottom and being slit vertically from the top to proximate the bottom to provide a series of panels whereby removal of some cigarettes will cause the cigarette spacer to expand.

5. The combination as set forth in claim 4 wherein the panels are each the width of a standard cigarette, are folded into the accordion shape and are under compression.

* * * * *